United States Patent [19]

Furukawa et al.

[11] Patent Number: 4,473,043

[45] Date of Patent: Sep. 25, 1984

[54] FLUID LUBRICATING CIRCUIT FOR ENGINES

[75] Inventors: Hideo Furukawa; Yasukuni Kawashima, both of Oyama, Japan

[73] Assignee: Kabushiki Kaisha Komatsu Seisakusho, Tokyo, Japan

[21] Appl. No.: 294,236

[22] Filed: Aug. 19, 1981

[30] Foreign Application Priority Data

Aug. 19, 1980 [JP] Japan ..... 55-116371

[51] Int. Cl.[3] ..... F01M 1/00

[52] U.S. Cl. ..... 123/196 AB; 123/457; 184/104 B; 138/26

[58] Field of Search ..... 123/196 AB, 195 A, 198 C, 123/196 S, 142.5 R, 196 PA, 196 CP, 457; 184/104 B; 237/12.3 A, 1 R; 126/247; 138/26

[56] References Cited

U.S. PATENT DOCUMENTS

| | | | |
|---|---|---|---|
| 2,764,147 | 9/1956 | Brunner | 126/247 |
| 2,899,979 | 8/1959 | Dahl et al. | 138/45 |
| 2,910,830 | 11/1959 | White | 138/26 |
| 3,465,847 | 9/1969 | Donath et al. | 123/196 AB |
| 3,485,324 | 12/1969 | Novak | 123/196 R |
| 4,136,824 | 1/1979 | Kallenback | 237/12.3 R |
| 4,205,637 | 6/1980 | Ito et al. | 123/457 |
| 4,249,491 | 2/1981 | Stein | 123/142.5 R |

FOREIGN PATENT DOCUMENTS 2628697 1/1977 Fed. Rep. of Germany .

*Primary Examiner*—Ethel R. Cross

*Attorney, Agent, or Firm*—Armstrong, Nikaido, Marmelstein & Kubovcik

[57] ABSTRACT

A fluid lubricating circuit for an internal combustion engine which can effectively damp or reduce fluid pressure pulsation in the circuit. To this end, the circuit includes a pressure damper connected between a hydraulic pump and an oil cooler. The pressure damper has formed therein a pair of orifices disposed in a spaced relation from each other in a direction of fluid flow and a damping chamber between the orifices.

3 Claims, 3 Drawing Figures

FLUID LUBRICATING CIRCUIT FOR ENGINES

BACKGROUND OF THE INVENTION

This invention relates to a fluid lubricating circuit for an internal combustion engine.

Usually fluid lubrication for parts to be lubricated in an engine is effected by driving a hydraulic pump and supplying lubricating fluid to the parts to be lubricated. When using such a hydraulic pump, especially a trochoid type hydraulic pump in an engine lubricating circuit, fluid pressure pulsation is likely to occur in the circuit, which may damage an oil cooler provided in the circuit.

SUMMARY OF THE INVENTION

It is therefore an object of the present invention to provide a fluid lubricating circuit for an internal combustion engine which can overcome the above noted problem of the prior art by effectively damping or reducing fluid pressure pulsation which may develop in the circuit.

Another object of the present invention is to provide a fluid lubricating circuit for an internal combustion engine wherein a pressure damper is disposed in the circuit between a hydraulic pump and an oil cooler so as to effectively damping or reducing fluid pressure pulsation which may develop in the circuit.

In accordance with an aspect of the present invention, there is provided a fluid lubricating circuit for an internal combustion engine, comprising: a reservoir, a hydraulic pump for pumping up a lubricating fluid from said reservoir, an oil cooler connected through a conduit with said hydraulic pump, filter means disposed between said oil cooler and said engine, and a pressure damper disposed between said hydraulic pump and said oil cooler for damping fluid pressure pulsations passing therethrough, said pressure damper having a first and second orifice provided in a spaced relation from each other in a direction of fluid flow, and a damping chamber disposed between said first and second orifices.

The above and other objects, features and advantages of the present invention will be readily apparent from the following description taken in conjunction with the accompanying drawing.

DESCRIPTION OF THE PREFERRED EMBODIMENTS

The present invention will now be described in detail below with reference to the accompanying drawings.

Figure 1:
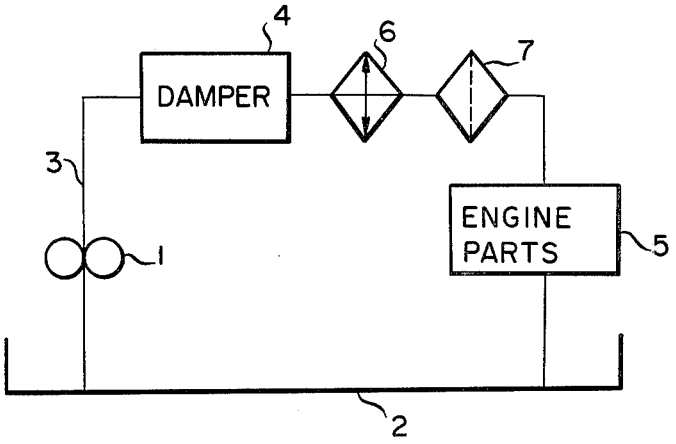
FIG. 1 is a schematic hydraulic circuit for fluid lubrication of an engine according to the present invention.

Referring first to FIG. 1, reference numeral 1 denotes a hydraulic pump such as a trochoid pump driven by an engine (not shown) for pumping up a fluid in a reservoir 2. Disposed in a delivery side conduit 3 of the pump 1 is a pressure damper 4 for damping or reducing a fluid pressure pulsation which may develop in the conduit 3. Fluid which has passed through the damper 4 is introduced into engine parts 5 to be lubricated such as bearings after passing through an oil cooler 6 and filter 7.

Figure 2:
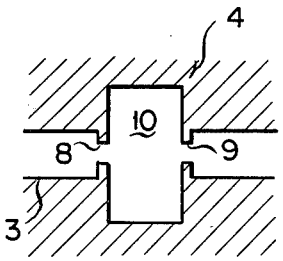
FIG. 2 is a cross-sectional view of a pressure pulsation damper employed in the hydraulic circuit according to the present invention.

The pressure pulsation damper 4, comprises as shown in FIG. 2. Specifically, the pressure pulsation damper 4 comprises a pair of orifices 8 and 9 formed in the conduit 3 being spaced from each other in a direction of fluid flow and a damping chamber 10 arranged between the orifices 8 and 9. The diameter of the damping chamber 10 is made larger than that of the conduit 3 while the diameter of each orifice 8 or 9 is made about $\frac{1}{2}$ to about $\frac{3}{4}$ the diameter of the conduit 3. Preferably, the volume of the damping chamber 10 is about 5 to about 10% the volume of delivery of the pump 1.

By disposing the pressure pulsation damper 4 in the delivery side conduit 3, lubricating fluid having a fluid pressure pulsation and flowing in the conduit 3 is damped or reduced in pressure due to resistance at the orifices 8 and 9 and pressure loss in the damping chamber 10.

Figure 3:
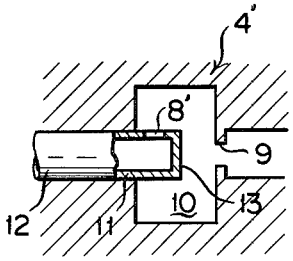
FIG. 3 is similar to FIG. 2 but showing another embodiment of pressure pulsation damper.

FIG. 3 shows another embodiment 4′ of the damper. In this embodiment, an upstream side orifice 8′ is formed in a side wall 11 of a pipe 12 having a closed bottom wall 13. Since pulsating pressurized fluid is introduced into the damping chamber 10 through the orifice 8′ after it is reflected by the bottom wall 13, pressure pulsation damping effect in this embodiment is greater than that of the first mentioned embodiment.

Since the present invention is comprised of as described hereinabove, fluid pressure pulsation in the conduit 3 is effectively damped or reduced thereby preventing hydraulic equipment such as the oil cooler 6 from being damaged.

Besides, since the pressure pulsation damper 4 of the present invention is comprised of a pair of orifices and a damping chamber, it is inexpensive to manufacture and has a high reliability as compared with diaphram type or gas chamber type dampers.

What is claimed is:

1. In a fluid lubricating circuit for an internal combustion engine including a reservoir, a hydraulic pump for pumping up at a delivery rate a lubricating fluid from said reservoir, an oil cooler connected through a conduit with said hydraulic pump, and filter means disposed between said oil cooler and said engine, the improvement comprising:

a pressure pulsation damper disposed between said hydraulic pump and said oil cooler for damping fluid pressure pulsations passing therethrough, said pressure pulsation damper having a first and a second orifice provided in a spaced relation from each other in a direction of fluid flow, and a damping chamber disposed between said first and second orifices, the chamber having a volume from about 5% to about 10% of said delivery rate of said pump.

2. A fluid lubricating circuit according to claim 1 wherein diameter of each of said orifices is about $\frac{1}{2}$ to about $\frac{3}{4}$ the diameter of the conduit.

3. A fluid lubricating circuit according to claim 1 wherein said first orifice is formed in a side wall of the conduit having a closed bottom wall.

* * * * *